US006789377B2

(12) United States Patent
Sting et al.

(10) Patent No.: US 6,789,377 B2
(45) Date of Patent: Sep. 14, 2004

(54) ENVELOPE-FILLING STATION

(75) Inventors: Martin Sting, Bad Vilbel (DE); Christian Botschek, Rödermark (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 213 days.

(21) Appl. No.: 09/821,338

(22) Filed: Mar. 29, 2001

(65) Prior Publication Data

US 2002/0124536 A1 Sep. 12, 2002

(30) Foreign Application Priority Data

Mar. 29, 2000 (DE) ..... 100 15 756

(51) Int. Cl.[7] ..... B65B 43/26
(52) U.S. Cl. ..... 53/569; 53/284.3; 53/381.5
(58) Field of Search ..... 53/569, 284.3, 53/460, 492, 381.5, 375.4

(56) References Cited

U.S. PATENT DOCUMENTS 4,020,615 A * 5/1977 Irvine et al.
4,674,258 A * 6/1987 Ehlscheid et al. ..... 53/569
4,866,908 A * 9/1989 Kiinne et al. ..... 53/381.5
5,388,388 A * 2/1995 Belec et al. ..... 53/460
5,560,185 A 10/1996 Petkovsek ..... 53/460
5,924,265 A * 7/1999 Auerbach ..... 53/460
6,289,658 B1 * 9/2001 Sting et al. ..... 53/569
6,293,076 B1 * 9/2001 Miller et al. ..... 53/460

FOREIGN PATENT DOCUMENTS

DE 2319866 11/1974
DE 19500746 A1 7/1996

* cited by examiner

*Primary Examiner*—Eugene Kim
*Assistant Examiner*—Sameh H. Tawfik
(74) *Attorney, Agent, or Firm*—Michael J. Cummings; Charles R. Malandra, Jr.; Angelo N. Chaclas

(57) ABSTRACT

An envelope filling station at which enclosures are pushed into envelopes. Envelopes are provide to the filling station via an envelope conveyor transverse to the push-in direction. A roller bar positioned above the conveyor is lowered while transporting envelopes and raised while documents are pushed into the stopped envelopes, A stop means, stops the envelopes on the conveyor at an appropriated filling location. Upstream of the conveyor an auxiliary conveying arrangement provides envelopes to the conveyor from a direction perpendicular to the conveyor.

5 Claims, 4 Drawing Sheets

ENVELOPE-FILLING STATION

BACKGROUND OF THE INVENTION

The invention relates to an envelope-filling station. Envelope-filling stations of this type are known in general. An example of such an envelope-filling station is described in German patent application DE 19500746 A1.

German patent application DE 2319866 A, describes an apparatus which is intended for conveying, closing and franking letter. That application describes that, individual envelopes are conveyed by a conveying-belt pair, from a stack of filled envelopes, over a bench, under a lifting beam equipped with a roller and actuated by means of a lifting magnet, and then, on the bench, deflected through 900 in relation to the conveying direction of the conveying belts, are pushed under bars with spring-mounted rollers which Interact with driven mating rollers, with the result that the envelopes can then be closed and franked, in order to remove build-ups, the bars with spring-mounted rollers are mounted on a frame arrangement which can be pivoted up by hand.

U.S. Pat. 5,560,185, describes operations of fixing and opening envelopes to be filled in an envelope-filling station. These operations are performed by sucker arrangements which act on the top side and the underside of the envelope transported into the envelope-filling station.

BRIEF SUMMARY OF THE INVENTION

The object of the present invention is to configure an envelope-filling station such that the operations of feeding envelop s, and conveying them further, relative to the push-in station, take place reliably, even at high operating speeds. Another object is an envelope filling station that is adjustable to different envelope-filling tasks.

The envelope-filling station proposed here is suitable for a space-saving construction and can be adapted in many different ways to different feeding directions of the enclosures or the sets of enclosures and of the individual envelopes.

BRIEF DESCRIPTION OF THE INVENTION

Exemplary embodiments are described in detail hereinbelow with reference to the drawings, in which.

DETAILED DESCRIPTION OF THE INVENTION

Figure 1:
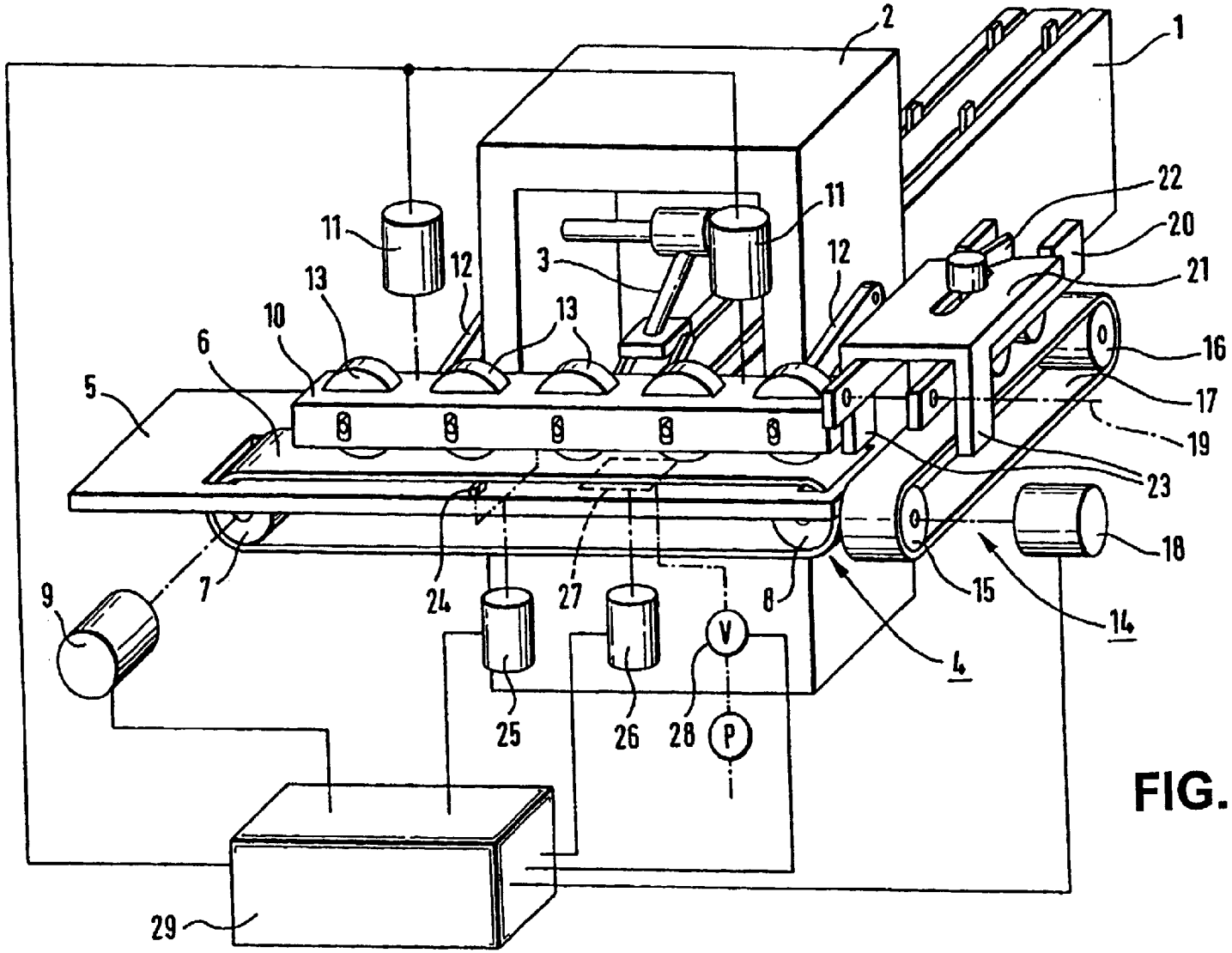
FIG. 1 illustrates a schematic, perspective view of an envelope-filling station of the type specified here.

The envelope-filling station of the type specified here and shown in FIG. 1 contains a conveyor 1 with a continuous or cyclically driven conveying chain. Conveying fingers project up beyond the top side of the conveyor 1 and form enclosure compartments which are lined up in a row along the top strand of the conveying chain and into which enclosures or sets of enclosures are introduced. Moreover, the envelope-filling station contains a push-in station 2 with a push-in arrangement 3. Push-in arrangement 3 contains push-in fingers which are articulated on a lever arrangement. When the lever arrangement is articulated, enclosures or sets of enclosures delivered by the conveying fingers are pushed by their trailing border and, during the operating thrust Into envelopes 30 which are held ready in a open state.

Finally, the envelope-filling station contains an envelope-conveying arrangement 4 with an envelope-filling bench 5. The envelope-filling bench 5 extends essentially transversely over the opening of the push-in station 2. Its top side is located approximately level with the top side of the conveyor 1.

The envelope-filling bench 5 is provided with cutouts through which an envelope-conveying belt 6 is routed such that its top strand runs over the envelope-filling bench 5. At its ends, the circulating envelope-conveying belt 6 is positioned over rollers 7 and 8 which are mounted, beneath the envelope-filling bench 5, on a framework which is not shown in FIG. 1. Roller 7 may be driven by a motor 9.

The simplified schematic illustration of FIG. 1 shows closed-border slots for the through-passage of the envelope-conveying belt 6. Alternatively open slots or cutouts may be provided in the envelope-conveying bench 5 to enable the envelope-conveying belt 6 to be positioned on the rollers 7 and 8 without splitting the envelope-conveying belt 6.

The envelope-conveying belt 6 runs transversely to the push-in direction of the push-in station 2, and can be driven such that its top strand is moved from right to left in relation to the illustration in FIG. 1.

By means of drives 11 Which are only schematically indicated here, a roller bar 10 can be lowered onto the top side of the top strand of the envelope-conveying belt 6, and raised from it, in a controlled manner. For this purpose, the roller bar 10 is articulated on the sides of the housing of the push-in station 2 via links 12.

The roller bar 10 contains a row of rollers 13 which are on the same track. The axes of rollers 13 are oriented transversely to the running direction of the envelope-conveying belt 6 and are spring-mounted in relation to the housing of the, roller bar 10.

At the beginning of the transport between the envelope-conveying belt 6 and the comparatively large-diameter rollers 13 of the roller bars 10, namely in the vicinity of the right-hand end of the envelope-filling bench 5 in FIG. 1, envelopes 30 which have been separated from a stack are conveyed up by an auxiliary conveying arrangement 14. In the auxiliary conveying arrangement 14, the envelopes 30 are moved in a horizontal direction perpendicular to the running direction of the top strand of the envelope-conveying belt 6. The auxiliary conveying arrangement 14 contains an auxiliary conveying belt 17 which is positioned over rollers 15 and 16. It is possible for the roller 15 to be driven in a controlled manner by means of a drive 18 in order to allow the top strand of the auxiliary conveying belt 17 to circulate in the direction of the beginning of the envelope-conveying belt 6. The top strand of the auxiliary conveying belt 17 is located approximately at the same level as the top strand of the envelope-convoying belt 6. The rollers 15 and 16 are mounted on a frame, which also serves for supporting the bearings of the rollers 7 and 8 for the envelope-conveying belt 6. Supported on frame parts projecting up beyond the level of the envelope-filling bench 5, or of the top strand of the auxiliary conveying belt 17 and of the envelope-conveying belt 6, is a bearing journal 19 Indicated by a dotted line in FIG. 1, bearing journal 19 serves for the pivot mounting of a cross-sectionally approximately U-shaped pivot frame 20. This pivot frame 20 extends rearwards from the bearing journal 19, above the top strand of the auxiliary conveying belt 17, counter to the conveying direction of the latter, On its underside, which is directed towards the top strand of the auxiliary conveying belt 17, the pivot frame 20 bears abutment rollers which interact with the top strand of the auxiliary conveying belt 17 (seen in part in FIG. 1). Moreover, a stop slide 21 is guided in a longitudinally displaceable manner on the pivot frame 20 and can be fixed in a certain position by means of a securing arrangement 22. The stop slide 21 contains stops 23 which extend laterally downwards on both sides of the pivot frame 20. The bottom ends of stops 23 extend at least to the level of the top side of the top strand of the auxiliary conveying belt 17.

Sensors 24 act through cutouts of the envelope-filling bench 5 are positioned proximal to the top strand of the envelope-conveying belt 6. A signal generator 25, delivers envelope-positioning signals from the sensors 24 to a central control unit 29. Also acting through cutouts of the envelope-filling bench 5, in the region between the top strand of the envelope-conveying belt 6 and the opening of the push-in station 2, are suction-cup arrangements 27 actuated by means of a drive 26. A solenoid valve 28 allows the suction-cup arrangement 27 to be subjected to a vacuum in a controllable manner. In conjunction with further apparatus parts, the suction-cup arrangement 27 serves for opening and keeping open the envelope 30 respectively conveyed in front of the opening of the push-in station 2, in order that the envelope can be filled with the enclosures or sets of enclosures.

As with other drives and control apparatuses which, in order to simplify the illustration, are not shown here, the drives 9, 11, 18, 26 and the solenoid valve 28 are connected to the central control unit 29. Control unit 29 is assigned to the relevant envelope-filling station or the mall-processing machine as a whole and controls the operation thereof.

The functioning of the apparatus parts described hitherto is explained herein below predominantly with reference to FIGS. 1–3.

Envelopes 30 are removed from a stack and separated in a known manner. Separated envelopes 30 are introduced into the conveying gap between the top strand of the auxiliary conveying belt 17 and the abutment rollers of the pivot frame 20, with the auxiliary conveying arrangement 14 in operation.

In the auxiliary conveying arrangement 14, envelopes are transported with the envelope opening oriented rearwards, and face down. The auxiliary conveying arrangement 14 moves the envelope 30 forwards parallel to the conveying direction of the conveyor 1 until the leading border of the envelope 30 runs up against the bottom ends of the stops 23 of the stop slide 21, whereupon the drive 18 of the auxiliary conveying belt 17 is brought to a standstill. Stopping of conveying belt 17 may be controlled by way of photocells. The stop slide 21 has previously been adjusted such that, when the envelope 30 is brought to a standstill by the stops 23, it is in an appropriate position for stuffing. The arrangement of the stops 23 on both sides of the auxiliary conveying belt 17 assists in accurately aligning the envelope 30.

Figure 2:
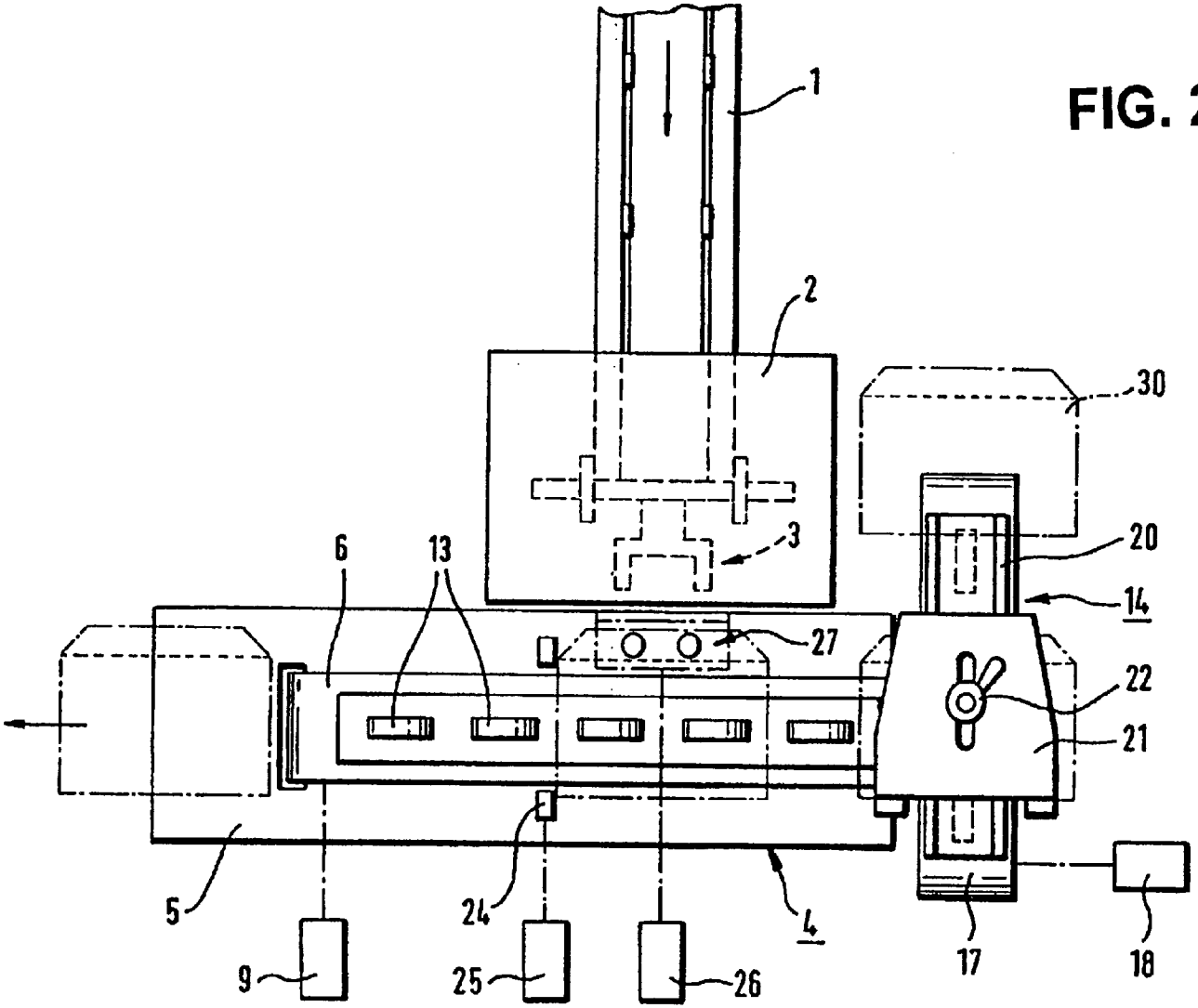
FIG. 2 illustrates a simplified plan view of the envelope-filling station according to FIG. 1.
Figure 3:
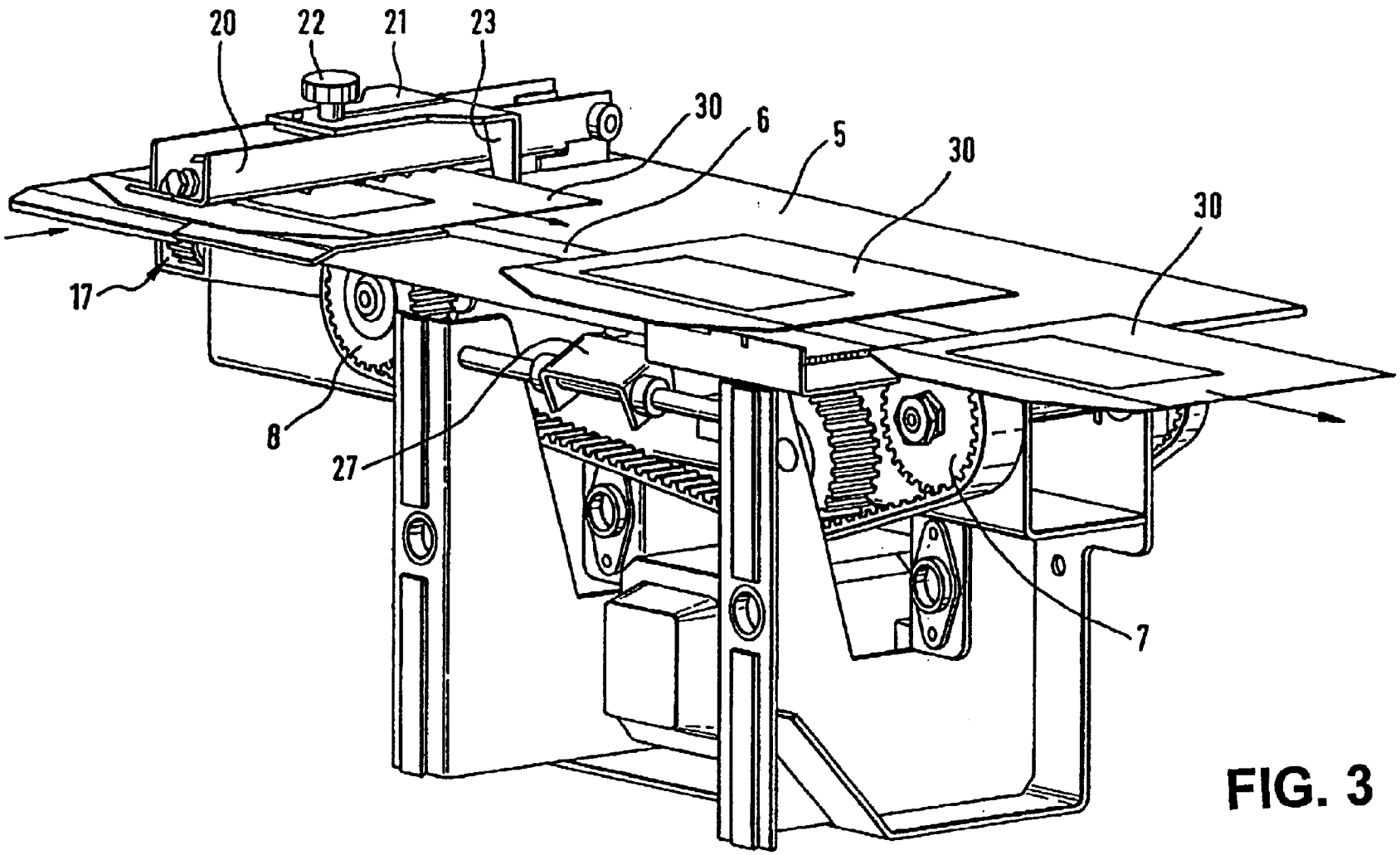
FIG. 3 illustrates a perspective Illustration of a practical embodiment of the envelope-conveying arrangement for the envelope-filling station according to FIGS. 1 and 2, as seen essentially from the push-in station.

It can be seen from the plan view of FIG. 2 that the envelope 30 fed to the envelope-conveying arrangement 4 projects beyond the auxiliary conveying belt 17 on both sides. If the envelope 30 is then located in a position in which its leading border butts against the stops 23, then the left-hand, projecting part of the envelope 30, in relation to the illustration in FIG. 2, already projects Into the region between the first roller 13 of the roller bar 10 and the top strand of the envelope-conveying belt 6.

As the envelope 30 is conveyed by the auxiliary conveying arrangement 17, the roller bar 10 is raised by the drives 11. The central control unit 29, controls the drives 11 so that the left-hand part of the envelope 30. In relation to the Illustration In FIG. 2, can run without obstruction into the space between the first roller 13 of the roller bar 10 and the top strand of the envelope-conveying belt 6.

The envelope-conveying belt 6 is set in motion when the drive 9 is switched on from the central control unit 29 and the roller bar 10 is lowered by the drives 11. The conveying gap between the first roller 13 and the conveying belt 6 grips the envelope 30 positioned against the stops 23 and draws it out past the stops 23 and between the pivot frame 20 and the top strand of the auxiliary conveying belt 17. The envelope 30 is then, by interaction of the rollers 13 of the roller bar 10 and the top strand of the envelope-conveying belt 6, conveyed further until its leading border, namely the left-hand edge in relation to the illustration in FIG. 2, comes into the region of the sensors 24. Based on sensors 24 detecting the envelope the signal generator 25, controls drive 9 to be switched off, with the result that, finally, the envelope 30 is conveyed precisely into the position in front of the opening of the push-in station 2.

The drive 26 of the suction-cup arrangement is then made to operate by opening the solenoid valve 28, a vacuum is brought Into effect, whereby the adhesive flap of the envelope 30 is secured on the envelope-filling bench 5. Moreover, the drives 11 are moved to raise the roller bar 10 off from the top strand of the envelope-conveying belt 6. At the same time the top part of the envelope 30 is raised, by means which will be described herein below, with the result that the envelope opening is open in order that the push-in arrangement 3 of the push-in station 2 can push into the envelope 30 an enclosure or a set of enclosures which has been conveyed up by the conveyor 1.

Once this has taken place, the drive 9 sets the envelope-conveying belt 6 In operation again and the filled envelope 30 leaves the region of the push-in station 2 in order to be closed and conveyed further.

Because of the comparatively large diameter and spring mounting of the rollers 13, the envelope-conveying arrangement 4 is not affected by variations In envelope thicknesses. Moreover, the envelope-conveying arrangement 4 can process a wide range of different envelope formats. For different format envelopes, it is necessary to provide for adjustability of the stop arrangement 23 parallel to the conveying direction of the envelope-conveying belt 6.

A further advantage of the envelope-filling station shown and described is when jams occur on the envelope-conveying path. These build-ups can easily be removed once the pivot frame 20 has been pivoted up and/or the roller bar 10 has been raised.

The bench top may be formed differently from the simplified form according to the schematic Illustration of FIG. 1. FIG. 3 depicts a preferred embodiment of the envelope-conveying arrangement. According to the embodiment of FIG. 3, the rollers 7 and 8 are arranged in a floating manner on a first side of a framework, for supporting the envelope-filling bench 5. The slots for the through-passage of the envelope-transporting belt 6 open towards the border of the envelope-filling bench 5 on the first side, with the result that the envelope-conveying belt 6 can be positioned on the rollers 7 and 8 from the first side of the arrangement.

The roller bar 10 has an essentially beam-like outline. The individual rollers 13 have a diameter in the range of from 40 mm and 100 mm.

Figure 4:
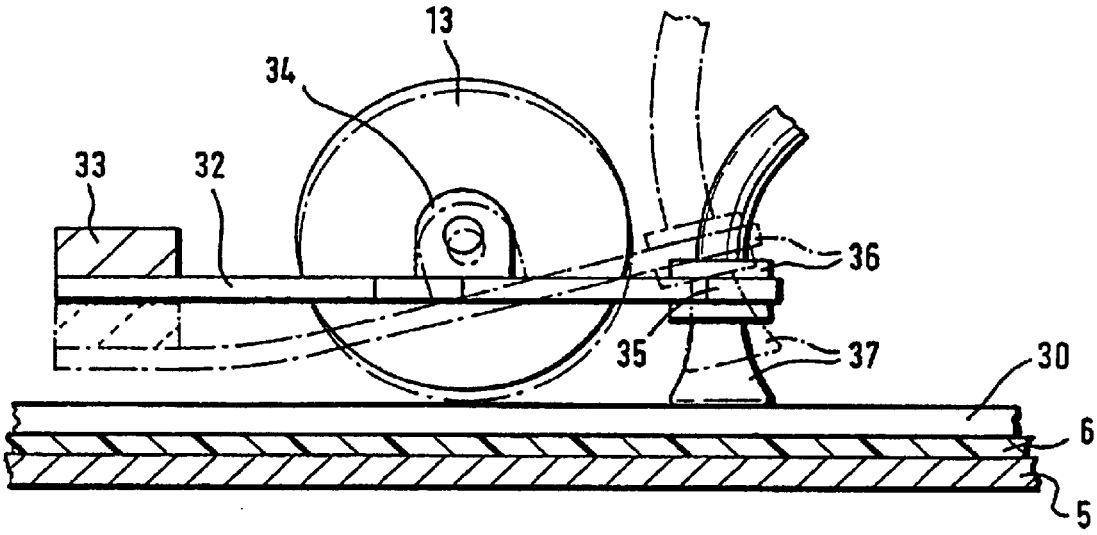
FIG. 4 illustrates a schematic side view of part of a constituent part of the roller bar forming the envelope-conveying arrangement.

FIG. 4 shows the bottom wall region of the housing of the roller bar 10, it being possible for this wall region to be divided up in a specific manner. Unlike the purely schematic illustration of FIG. 1, the side walls and the top wall of the housing of the roller bar 10 may be provided with through-passages, cutouts, stiffening ribs and the like. It is possible in particular for the housing of the roller bar 10 to be designed, in its entirety, as a plastic injection moulding. The shaping of the injection moulding may be provided by corresponding cutouts. In the specific embodiment of the roller bar 10. Illustrated schematically in FIGS. 4 and 5, the bottom wall region of the housing is formed by a series of approximately V-shaped spring tongues 32, of which the lateral legs are connected at 33 to side-wall parts of the housing of the roller bar 10 and anchored thereon. The lateral legs of the spring tongues 32 extend inwards, in an angled manner in their center plane, to form upwardly projecting bearing lugs 34, on which the rollers 13 are mounted in each case. Finally, the spring tongues 32 contain a U-shaped part 35 which connects the side legs and in the vertex region of which is located the through-passage for the connection 36 of a suction cup 37 assigned in each case to some of the rollers 13.

If the roller bar 10 is raised off from the top strand of the envelope-conveying belt 6 by the drives 11, each of the rollers 13 on the housing of the roller bar 10 assumes, relative to an envelope 30 which rests on the top strand of the envelope-conveying belt 6, the position which is Illustrated by solid lines in FIG. 4. The bottom vertex of the roller 13 is at a certain distance from the top side of the envelope 30. The spring tongue 32 of the base region of the housing of the roller bar 10, said spring tongue serving for mounting the roller 13, is located horizontally at a certain distance above the envelope 30. If the roller bar 10 is raised further, the distance also Increases such that the bottom opening of the suction cup 37 also maintains a certain distance from the top side of the envelope 30.

Figure 5:
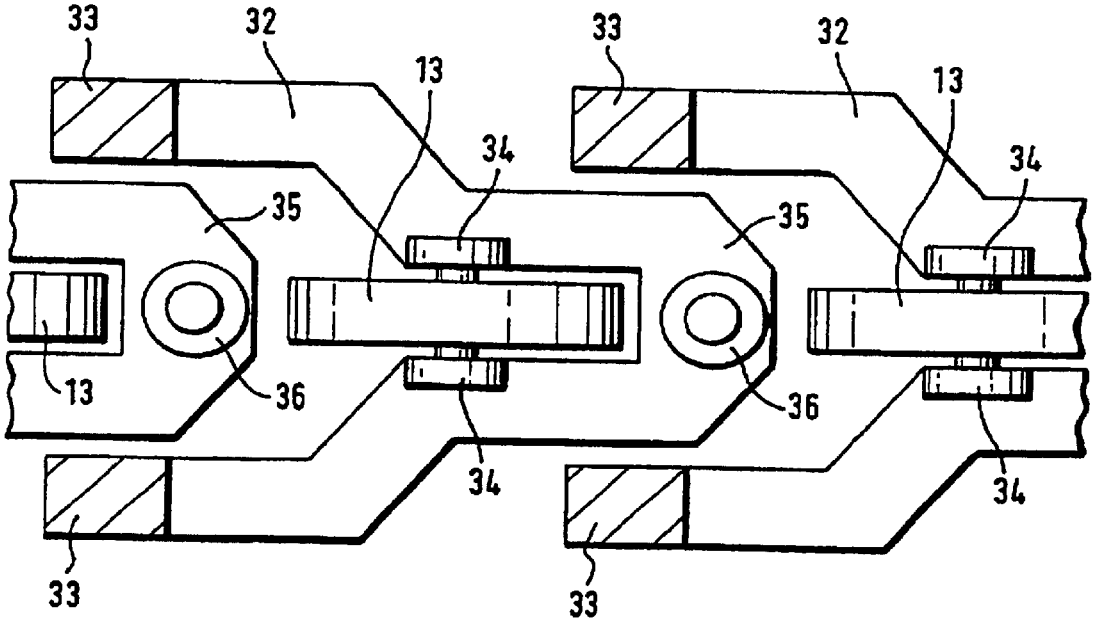
FIG. 5 illustrates a plan view of the bottom region of the roller bar, which is shown in detail form in FIG. 4.

If, however, the roller bar 10 is lowered, the lowest point of the roller 13 is positioned on the top side of the envelope 30 and presses the envelope 30 against the moving envelope-conveying belt 6. In order, however, to avoid the situation where the top side of the envelope 30 is then drawn with friction along the opening of the suction cup 37, the roller bar 10 is lowered further, with the result that the position depicted by chain-dotted lines in FIG. 4 is reached. In this position, the spring tongues 32 are bent upwards from the anchoring locations 33 because they are pressed upwards at the bearing lugs 34 by the spindles of the rollers 13. The connections 36 at the front ends, in the region of the part 35 of the spring tongues 32, are raised as a result and the suction cups 37 are raised off from the top side of the envelopes 30. In this state, the envelope-conveying arrangement 4 can convey envelopes 30 without obstruction to a stop arrangement (see FIGS. 1 and 2). It the envelope-conveying belt 6 is then brought to a standstill and the roller bar 10 is raised into the position represented by solid lines in FIG. 4, the suction cups 37 are positioned on the top side of the envelope 30. If the suction cups 37 are then subjected to a vacuum, they are then secured firmly by suction on the top side of the envelope 30. Further raising of the roller bar 10 subsequently causes the envelope 30 to be opened. During opening the adhesive flap of the envelope is secured to the envelope-filling bench 5 by the suction-cup arrangement 27. It can be seen that the arrangement shown in FIGS. 4 and 5 provides a drive for the suction-cup arrangement 36/37, which acts on the top side of the envelopes, in the form of the drive of the roller bar 10.

The lateral legs of the spring tongues 32 may be referred to as leaf-spring pairs. Unlike the embodiment shown, it is also possible for the bearing lugs 34 and a securing means for the connection 36 of suction cups 37 to be provided on individual leaf springs which are routed to the anchoring locations 33 of the carrier housing of the roller bar 10.

What is claimed is:

1. An envelope-filling station comprising:

an envelope-filling bench, a push-in station having a push-in arrangement for pushing enclosures into envelopes, an envelope-conveying arrangement, on the envelope-filling bench, conveying envelopes into the push-in station into a position opposite the push-in arrangement and being opened there and held ready for receiving the enclosures or sets of enclosures and, once filled, being conveyed further;

wherein the envelope-conveying arrangement comprises a circulating envelope-conveying belt, of which a top strand is guided over the envelope-filling bench and is oriented transversely to a push-in direction, a roller bar equipped with spring-mounted rollers arranged to be lowered and raised onto the top side of the top strand of the envelope-conveying belt, in a controlled manner, stop means proximal to the push-in station arranged contiguous to the top strand of the envelope-conveying belt and controlled to be brought into an active position directly above the level of the envelope-filling bench, and removed therefrom into an inactive position, in a controller manner, such that envelopes which have been conveyed are brought to a standstill in a position opposite the push-in arrangement with the stop means active and with the roller bar lowered, are filled with the roller bar raised and are conveyed further with the stop means inactive and the roller bar lowered again, and wherein a beginning of the top strand of the envelope-conveying belt, by means of an auxiliary conveying arrangement, envelopes can be conveyed up separately against in particular adjustable stops from a horizontal direction perpendicular to the running direction of the top strand of the envelope-conveying belt, such that subregions of the respective envelope which has run up against the further stops-extend into a gap between the raised roller bar and the beginning of the top strand of the envelope-conveying belt such that, when the roller bar is lowered against the top strand of the circulating envelope-conveying belt, the relevant envelope is drawn in front of the push-in arrangement in the conveying direction of said envelope-conveying belt.

2. An envelope-filling station according to claim 1, wherein the operation of feeding the separated envelopes out of an envelope-separating station from a horizontal direction perpendicular to the running direction of the top strand of the envelope-conveying belt takes place by means of an auxiliary conveying belt and abutment rollers or abutment belts interacting therewith.

3. An envelope-filling station according to claim 1, wherein the roller bar has a beam-like carrier housing which is coupled to drive means for raising and lowering it and on which spring elements are anchored, these retaining bearings for supporting on both sides the journals of disc-like, comparatively large-diameter rollers.

4. An envelope-filling station according to claim 3, wherein at least one of the spring elements bears, on spring sections extending from the anchoring locations, starting from the bearings, suction-cup arrangements which are connected to a vacuum source via flexible vacuum lines and controllable valves and of which the suction-cup openings, with the roller bar raised off from the top strand of the envelope-conveying belt, extend down at least to the level of the lowermost circumferential regions of the rollers, and with the roller bar lowered onto the top strand of the envelope-conveying belt and the rollers loaded, with spring element deformation taking place in the process, are raised by way of the spring sections, above the level of the lowermost circumferential regions of the rollers, the suction-cup arrangement serving for opening and keeping open the envelopes during the actuation of the push-in arrangement.

5. An envelope-filling station according to claim 3, wherein the carrier housing of the roller bar and the spring elements are designed in one piece, in particular as a plastic injection moulding.

* * * * *